US009163798B2

(12) United States Patent
Chartreand et al.

(10) Patent No.: US 9,163,798 B2
(45) Date of Patent: Oct. 20, 2015

(54) FLAMELESS CANDLE INTERNAL LIGHT SHIELD

(75) Inventors: Mathieu Chartreand, Lery (CA); Bernard Fournier, Delson (CA)

(73) Assignee: WINVIC SALES INC., Markham, Ontario (CA)

( * ) Notice: Subject to any disclaimer, the term of this patent is extended or adjusted under 35 U.S.C. 154(b) by 571 days.

(21) Appl. No.: 13/174,153

(22) Filed: Jun. 30, 2011

(65) Prior Publication Data

US 2013/0003385 A1 Jan. 3, 2013

(51) Int. Cl.

| | |
|---|---|
| ***F21S 6/00*** | (2006.01) |
| ***F21S 10/04*** | (2006.01) |
| ***F21V 11/16*** | (2006.01) |
| *F21Y 101/02* | (2006.01) |

(52) U.S. Cl.

CPC ..... *F21S 10/04* (2013.01); *F21S 6/001* (2013.01); *F21V 11/16* (2013.01); *F21Y 2101/02* (2013.01)

(58) Field of Classification Search

CPC ..... F21S 6/001; F21S 10/04; F21V 11/16; F21Y 2101/02

USPC ..... 362/296.01, 257, 311.01, 351, 477, 362/311.02, 296.05, 311.13, 800, 810, 392

See application file for complete search history.

(56) References Cited

U.S. PATENT DOCUMENTS

| | | | | |
|---|---|---|---|---|
| 6,685,345 | B1 * | 2/2004 | Velasquez | 362/392 |
| 7,011,426 | B2 * | 3/2006 | Gabor | 362/161 |
| 7,093,961 | B2 * | 8/2006 | Bentley et al. | 362/355 |
| 7,246,917 | B2 * | 7/2007 | Rhoads et al. | 362/241 |
| 7,261,455 | B2 | 8/2007 | Schnuckle | |
| 7,422,355 | B2 | 9/2008 | Hirata | |
| 7,997,772 | B2 * | 8/2011 | Avtzon et al. | 362/392 |
| 2003/0067790 | A1 | 4/2003 | Brown | |
| 2004/0179355 | A1 | 9/2004 | Gabor | |
| 2008/0043461 | A1 | 2/2008 | Xiao | |
| 2009/0040756 | A1 | 2/2009 | Avzton | |
| 2010/0259937 | A1 * | 10/2010 | Wu et al. | 362/296.01 |

FOREIGN PATENT DOCUMENTS

| | | | |
|---|---|---|---|
| CN | 2888274 | Y | 4/2007 |
| WO | WO/0192780 | | 12/2001 |
| WO | WO2005/074998 | A1 | 8/2005 |

OTHER PUBLICATIONS

PCT, Notification of the International Search Report and the Written Opinion of the International Searching Authority, or the Declaration, in International application No. PCT/CA2012/000464, dated Aug. 9, 2012 (7 pages).

(Continued)

*Primary Examiner* — Sharon Payne

(74) *Attorney, Agent, or Firm* — McAndrews, Held & Malloy, Ltd.

(57) ABSTRACT

According to embodiments of the present invention, a flameless candle is claimed, depicted, and described. The candle has a hollow interior region, an inner surface having an radius, and an outer surface having an outer radius. The candle also has a riser located within the hollow interior region. A lamp (e.g., LED) is also located in the interior region and above the riser. A light shield is located within the hollow interior region. The light shield is below the lamp and has an outer bound with a radius. The light shield also has a sloped portion. The light shield may have a reflector. The radius of the outer bound of the light shield is less than the radius of the inner surface of the candle shell. The sloped portion of the light shield slopes downwardly towards the outer bound.

13 Claims, 3 Drawing Sheets

(56) References Cited

OTHER PUBLICATIONS

European Patent Office, Communication with extended European search report, in Application No. 12807181.8, dated Oct. 30, 2014 (7 pages).

The State Intellectual Property Office of the People's Republic of China, Application No. 2012800012722, dated Sep. 2, 2014. (16 pages).

* cited by examiner

FLAMELESS CANDLE INTERNAL LIGHT SHIELD

RELATED APPLICATIONS

[Not Applicable]

FEDERALLY SPONSORED RESEARCH OR DEVELOPMENT

[Not Applicable]

MICROFICHE/COPYRIGHT REFERENCE

[Not Applicable]

BACKGROUND OF THE INVENTION

Generally, the present application relates to flameless candles. Particularly, the present application relates to techniques for illuminating an outer surface of a candle shell in a flameless candle.

Flameless candles may have candle shells that include wax or a waxen material. As used herein, a waxen material encompasses wax, a wax substitute, or similar materials. The waxen material may allow the flameless candle to appear more like a conventional flamed candle. While the waxen material may provide such benefits, it can be relatively expensive.

Because a flameless candle does not consume the wax, it may not be necessary to have a candle body that is solid. Instead, it may be preferable to have a hollow interior region within the candle body, such as a candle shell. Such a design requires less material. An electronics insert, including a lamp such as a light-emitting diode ("LED"), may then be inserted into the candle shell and at least partially into the interior region.

One desirable effect of a flameless candle is to provide an illusion of a conventional flamed candle. The conventional flamed candles are, typically, solid wax. As discussed above, flameless candles may have a hollow interior region. Consequently, the illumination pattern of a conventional candle may differ from that of a flameless candle with a hollow interior region. An example of an illumination pattern in a prior art flameless candle with a hollow interior region is illustrated in FIG. 4. Such an illumination pattern may not effectively mimic that of a solid wax candle. Furthermore, the hollow region may contain irregular structures, such as batteries, electronics, supports, or the like. Such structures may cause irregular illumination patterns.

One known technique for influencing the illumination pattern of the outer surface of a flameless candle is to place a light-blocking barrier between the hollow interior region and the light source. Such a technique is shown in European Patent No. 1,419,345. However, this technique is intended to block substantially all of the light from entering into the hollow interior region of the flameless candle. Consequently, this technique may not effectively illuminate the outer surface to generate the illusion of a solid wax candle. Thus, it may be desirable to have a flameless candle that solves these and other problems.

BRIEF SUMMARY OF THE INVENTION

According to embodiments of the present invention, a flameless candle is claimed, depicted, and described. The candle has a hollow interior region, an inner surface having an radius, and an outer surface having an outer radius. The candle also has a riser located within the hollow interior region. A lamp (e.g., LED) is also located in the interior region and above the riser. A light shield is located within the hollow interior region. The light shield is below the lamp and has an outer bound with a radius. The light shield also has a sloped portion. The top surface of the light shield may be reflective. The radius of the outer bound of the light shield is less than the radius of the inner surface of the candle shell. The sloped portion of the light shield slopes downwardly towards the outer bound.

The candle shell may have an outer surface with an upper region at a height above the light shield and a lower region at a height below the light shield. The riser, the lamp, and the light shield are configured to shape an illumination pattern on the outer surface of the candle shell. The illumination pattern may have a focal band and a tapered band. As an example, the light shield can configured to shape the tapered band through selection of the slope of the sloped portion. The shaping can also be made by adjusting the width of the space between the outer bound of the light shield and the inner surface of the candle shell. The light shield may also be configured to shape the focal band through selection of the slope of the sloped portion.

In an embodiment, the flameless candle has a base portion configured to support the riser. The base portion may have an electronics portion that provides current to the lamp. The electronics portion may cause the lamp to flicker like a candle flame. In another embodiment, there is a simulated wick above the lamp (e.g., directly above the lamp).

According to embodiments of the present invention, a light shield is claimed, depicted, and described. The light shield is adapted for use within a hollow region of a flameless candle. The light shield has an outer bound having a radius. It also has an inner aperture having a height greater than a height of the outer bound. The inner aperture can accommodate a plurality of conductors for the LED. The light shield also has a sloped region between the inner aperture and the outer bound. The radius of the outer bound is less than a radius of an inner surface of the hollow region of the flameless candle. This forms a space between the outer bound of the light shield and the inner surface of the hollow region. The shape of the light shield can be selected to shape an illumination pattern that will project onto the outer surface of the flameless candle. For example, the light shield can shape a tapered band and a focal band in the illumination pattern. In an embodiment, the light shield has a reflector. In another embodiment, the light shield can mount on a riser.

Figure 2:
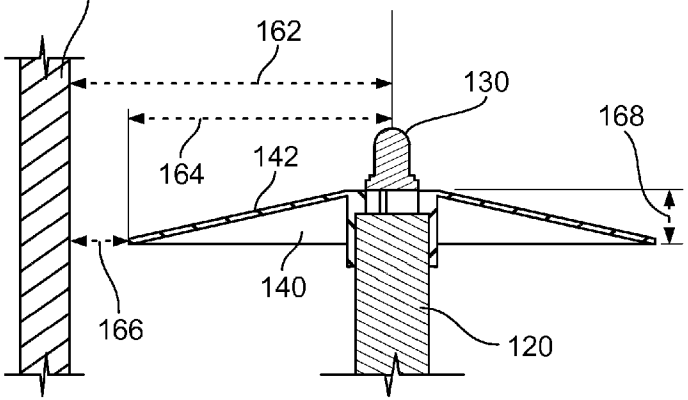
FIG. 2 shows a vertical cross-sectional view of a portion of a flameless candle including a light shield, according to an embodiment of the present invention.

The foregoing summary, as well as the following detailed description of certain embodiments of the present invention, will be better understood when read in conjunction with the appended drawings. For the purposes of illustration, certain embodiments are shown in the drawings. It should be understood, however, that the claims are not limited to the arrangements and instrumentality shown in the attached drawings. Furthermore, the appearance shown in the drawings is one of many ornamental appearances that can be employed to achieve the stated functions of the system.

DETAILED DESCRIPTION OF THE INVENTION

Figure 1:
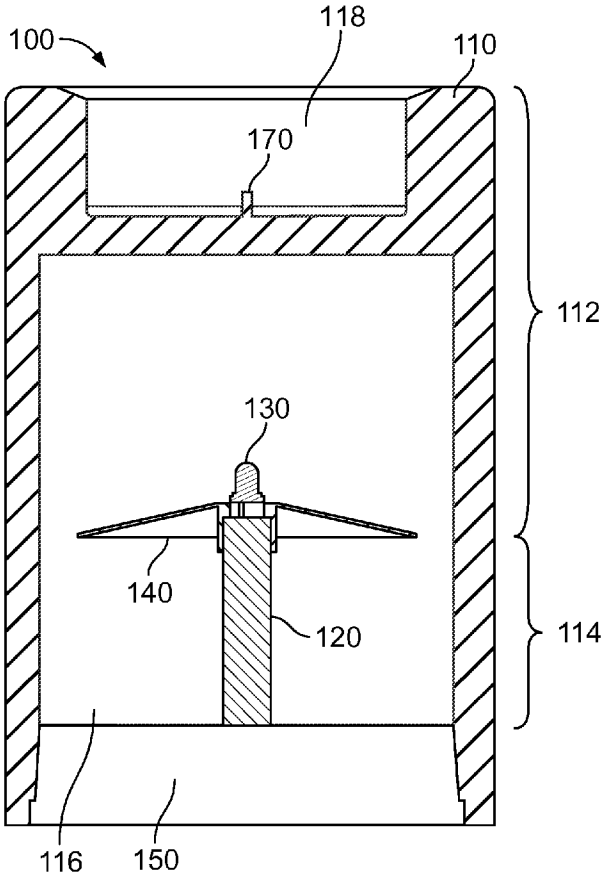
FIG. 1 shows a vertical cross-sectional view of a flameless candle, according to an embodiment of the present invention.

FIG. 1 shows a vertical cross-sectional view of a flameless candle 100, according to an embodiment of the present invention. The flameless candle 100 may include a shell 110, a base 150, a riser 120, a lamp 130, and a light shield 140. The flameless candle 100 may also include a simulated wick 170.

The candle shell 110 may include an external surface with an upper region 112 and a lower region 114. The upper region 112 may be at a height above the light shield 140. The lower region 114 may be at a height below the light shield 140. The candle shell 110 may further include an interior region 116, which may be generally hollow. The candle shell 110 may further include a well 118. The simulated wick 170 may be located within the well 118. The candle shell 110 may include an opening on the bottom. The opening and the interior region 116 may be configured to accept the base 150, riser 120, lamp 130, and light shield 140.

Figure 3C:
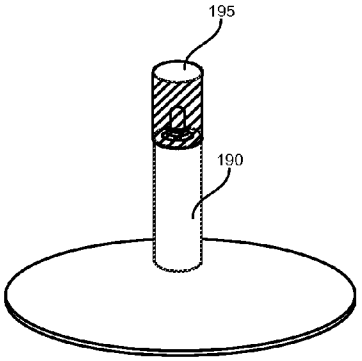
FIG. 3C shows a portion of a flameless candle including a light shield, and extension, and a diffusing member, according to an embodiment of the present invention.
Figure 3B:
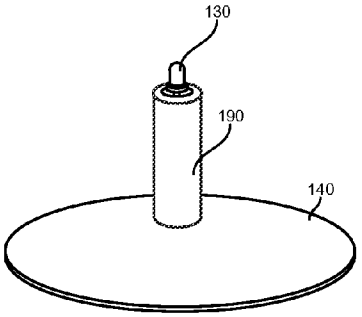
FIG. 3B shows a portion of a flameless candle including a light shield and an extension, according to an embodiment of the present invention.
Figure 3A:
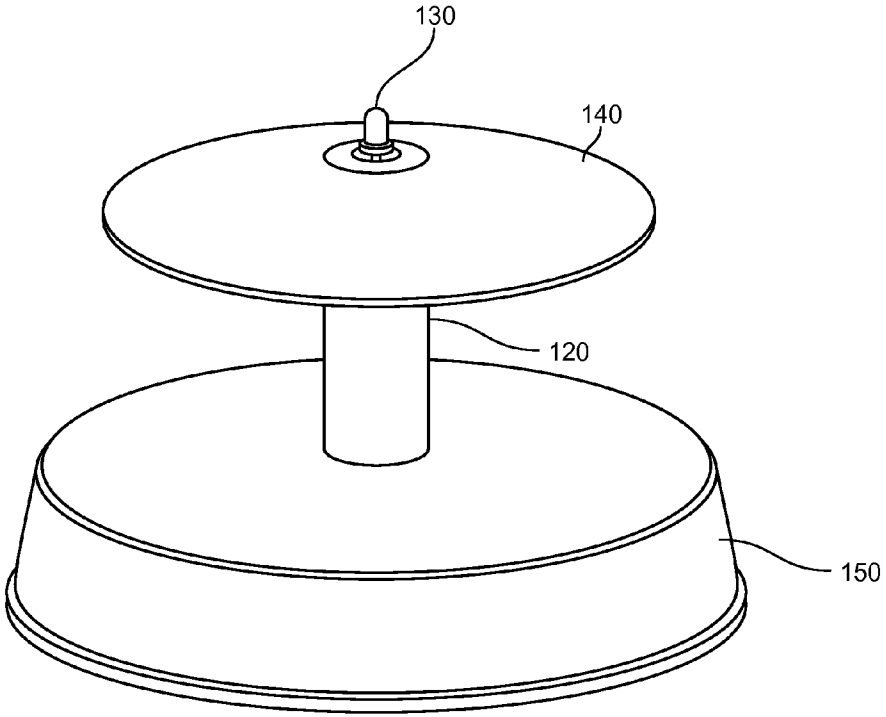
FIG. 3A shows a portion of a flameless candle including a light shield, according to an embodiment of the present invention.

The base 150 may support the riser 120. The light shield 140 and lamp 130 may be supported by the riser 120. A plurality of conductors may be inside or run alongside the riser 120. The plurality of conductors may provide electrical current to the lamp 130. Another illustrative example of the base 150, a riser 120, lamp 130, and light shield 140 is also shown in FIG. 3A. As another example, an extension 190 may rise above the light shield 140 as shown in FIG. 3B. The lamp 130 may be above the extension 190. The conductors may run inside or alongside the extension 190. As another example, a light-diffusing member 195 may diffuse light from the lamp 130 as shown in FIG. 3C. For example, the light-diffusing member 195 may be partially opaque. The light-diffusing member 195 may be cylindrical or may have other shapes, such as a dome. The light-diffusing member 195 may surround the lamp. The light-diffusing member 195 may have one or more apertures, such as an aperture at the top.

Turning back to FIG. 1, the riser 120, lamp 130, and light shield 140 may be located within the interior region 116 of the candle shell 110. The lamp 130 may produce a flickering light when turned on. The lamp 130 may be one or more light-emitting diodes ("LED") or incandescent bulbs. Batteries may be electrically connected with the lamp 130 or electronics in the base 150, and may be configured to provide electrical power to the lamp 130 (either directly or through the electronics). A switch may be configured to interrupt a flow of current through the lamp 130 so that the batteries do not provide electrical power to the lamp 130. For example, the switch could cause a circuit to open or close—either by directly switching the flow of current or by implementing the switch to toggle the state of an input to a circuit or processor that controls the flow of current through the lamp 130. The switch may toggle or otherwise adjust other aspects, such as the level of light intensity or the type of flickering emitted from the lamp 130.

The electronics may include an illumination circuit designed to illuminate the lamp 130. For example, an illumination circuit could be designed to vary the current flowing through the lamp 130 to cause the lamp 130 to approximate the behavior of a real candle flame. An illumination circuit could be implemented by one or more oscillator circuits and/or a microprocessor. As an example, the illumination circuit could be two or more oscillator circuits, each of which are capable of operating at different frequencies and/or phases. In this example, the sum of the outputs of the oscillation circuits could be employed to variably control the current flowing through the lamp 110, thereby creating a flickering illusion of a real candle flame. As another example, the illumination circuit may be a microprocessor executing one or more algorithms.

The light shield 140 may have an outer bound that is circular. The light shield 140 may have an outer bound with other shapes, such as a square, oval, etc. The light shield 140 may have a conical shape. The light shield 140 may have a sloped portion 142. The sloped portion 142 may slope downwardly towards the outer bound of the light shield 140. In an embodiment, the sloped portion 142 may be horizontal. In another embodiment, the sloped portion 142 may slope upwardly.

If the sloped portion 142 slopes downwardly, it may facilitate the manufacturing process of a flameless candle. For example, one manufacturing technique involves the use of hot glue which has a relatively low viscosity when hot. First, the candle shell 110 is turned upside down. Hot glue is poured into the interior region 116. A sub-assembly (e.g., the base 150, riser 120, lamp 130, and light shield 140) is then inserted into the hollow region 116. The candle shell 110 is then flipped right-side up. The hot glue then flows down the walls of the hollow region 116 and onto the base 150 where a seal is made once the glue cools. If the sloped portion 142 slopes downwardly, then the dripping hot glue may run off and down onto the base 150. Thus, a downwardly sloping sloped portion 142 may facilitate funneling the hot glue towards desirable locations and away from undesirable locations.

The upper surface of the light shield 140 may include a material that is reflective or a reflector. The light shield 140 may be configured and located to reflect light emitted from the lamp 130 and/or reflected from the inner surface of the candle shell 110. The light shield 140 may have in inner aperture to pass the conductors to the lamp 130. The light shield 140 may be configured to mount on the riser 120. In an embodiment, the light shield 140 may be mounted on the riser 120 when the light shield 140 and riser 120 are formed together.

FIG. 2 shows a vertical cross-sectional view of a portion of the flameless candle 100 including the light shield 140, according to an embodiment of the present invention. Various dimensions are depicted with dotted lines. Distance 162 illustrates a radius within the interior region 116 of the candle shell 110. Distance 164 illustrates a radius of the outer bound of the light shield 140. Distance 166 illustrates a width of a space between the radius 162 and the radius 164. Distance 168 illustrates the height of the light shield 140. The height 168 and the radius 164 of the light shield impact the steepness of the sloped portion 142 of the light shield 140.

Turning back to FIG. 1, the effects of the light shield 140 will be generally described. As discussed, the light shield 140 may reflect light. In such a scenario, some light generated by the lamp 130 is effectively blocked from passing through the light shield 140 and into the lower area of the interior region 116 of the candle shell 110. Such light will generally be reflected into the portion of the interior region 116 which is above the light shield 140.

Some light, however, can pass through the space between the light shield 140 and the interior surface of the candle shell 110. By selecting the shape, radius 164, and slope 142 of the light shield 140, it may be possible to control how light enters into the lower area of the interior region 116 and how light is reflected into the upper area of the interior region 116.

Figure 4:
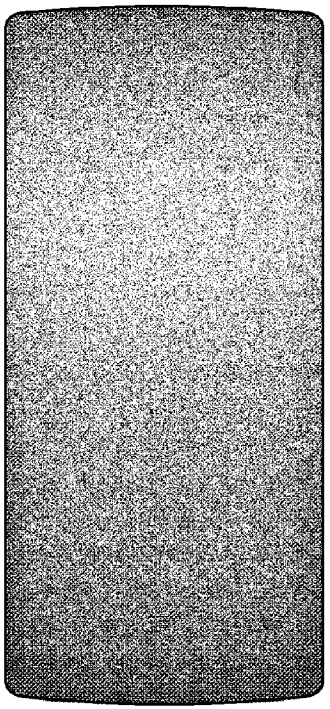
Prior Art FIG. 4
FIG. 4 shows an illumination pattern of a prior art flameless candle.

FIG. 4 shows an illumination pattern of a prior art flameless candle. As shown, the illumination pattern fills substantially the entirety of the outer surface of the candle shell, at least for the portions of the outer surface below the well (not shown). The illumination pattern of the prior art candle is diffuse and may fail to create an effective illusion of a conventional solid wax candle.

Figure 5B:
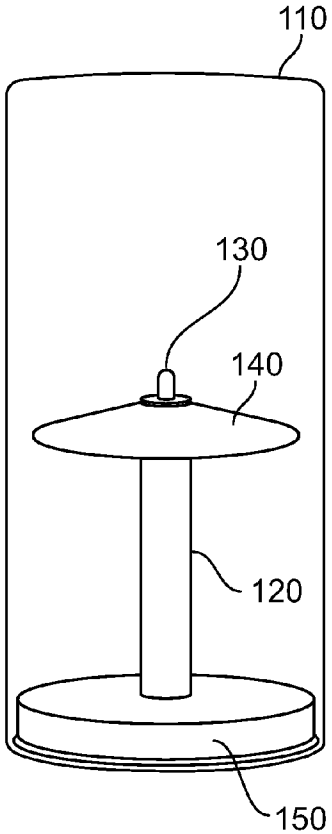
FIG. 5B shows a flameless candle including a light shield, according to an embodiment of the present invention.
Figure 5A:
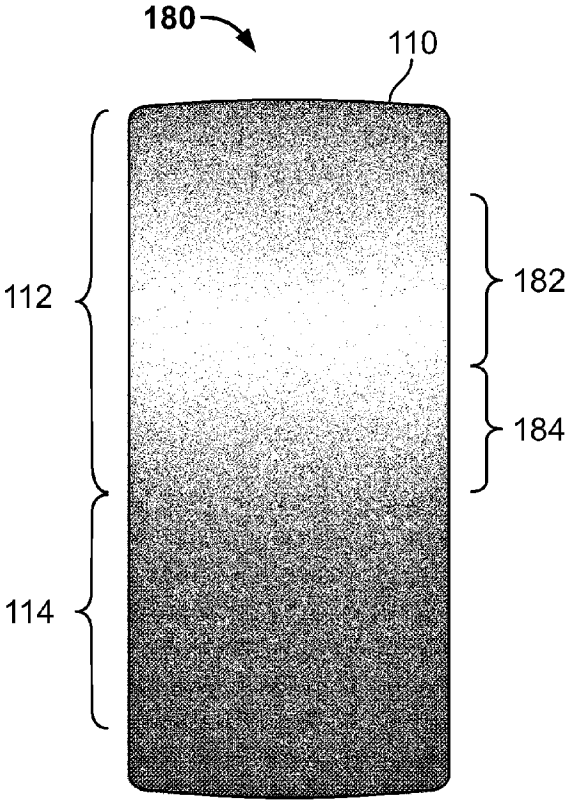
FIG. 5A shows an illumination pattern of a flameless candle including a light shield, according to an embodiment of the present invention.

FIGS. 5A and 5B show a flameless candle 100 including a light shield 140 and the resulting illumination pattern 180 on the external surface of the candle shell 110, according to an embodiment of the present invention. The illumination pattern 180 shown in FIG. 5A is concentrated and noticeably different from the diffuse pattern shown in FIG. 4. This is a result of the light shield 140, which controls how the light fills the interior region 116 of the candle shell 110.

FIGS. 5A and 5B represent different aspects of the same candle 100. FIG. 5B illustrates the position and dimension of a light shield 140 within the candle, while FIG. 5A shows the resulting illumination pattern 180.

As shown in FIG. 5A, the illumination pattern 180 includes a focal band 182 and a tapered band 184 below the focal band 182. The illumination pattern 180 may also have a tapering region above the focal band 182. By adjusting the dimensions of the riser 120, lamp 130, and light shield 140, the patterns of the focal band 182 and the tapered band 184 can be changed to shape the overall illumination pattern 180. The illumination pattern 180 may be shaped to simulate that of a particular conventional solid wax candle.

The illumination pattern 180 may also be shaped to create unconventional effects. For example, a flameless candle may have a design located on the outer surface of the candle (or embedded or located on the candle in some other manner). The light shield 140 may be tailored to have dimensions that create a focal band 182 to customize or emphasize the illumination of such a design.

Generally speaking, the introduction of the light shield 140 will cause light to be more concentrated in the upper region 112 and less concentrated in the lower region 114 of the outer surface of the candle shell 110, as compared to a flameless candle without a light shield.

By changing the width of the space between the outer bound of the light shield 140 and the inner surface of the candle shell 110 (see, e.g., FIG. 2, reference 166), the illumination pattern of the tapered band 184 can be shaped. An increase of the width of the space between the outer bound of the light shield 140 and the inner surface of the candle shell 110 may broaden the tapered band 184. Contrarily, a decrease in the width of the space may compress the tapered band 184. The tapered band 184 can also be altered by changing the slope of the sloped portion of the light shield 140. An increase of the slope may broaden the tapered band 184, and a decrease in the slope may compress the tapered band 184.

The illumination pattern 180 of the focal band 182 can also be changed by adjusting the slope of the sloped portion 142 of the light shield 140 and the size of the space between the outer bound of the light shield 140 and the inner surface of the candle shell 110. By increasing the slope, the focal band 182 may be lowered and broadened. By reducing the slope, the focal band 182 may be higher and compressed. Additionally, because the size of the space has an impact on how much light passes below the light shield 140, the size of the space may have an effect on the intensity of the light in the focal band 182 and may broaden the focal band 182.

Other factors may also influence the illumination pattern 180 on the outer surface of a flameless candle 100. Such factors include the height of the lamp 130, the brightness of the lamp 130, the radiation pattern of the lamp 130, the height of the light shield 140 with respect to the lamp 130, the thickness of the candle shell 110, the size of the hollow region 116, the reflectivity of the light shield 140, or the like.

While the invention has been described with reference to certain embodiments, it will be understood by those skilled in the art that various changes may be made and equivalents may be substituted without departing from the scope of the invention. In addition, many modifications may be made to adapt a particular situation or material to the teachings of the invention without departing from its scope. For example, using the techniques described herein, other aspects of the illumination pattern 180 may also be shaped, such as the tapering region above the focal band 182. Therefore, it is intended that the invention not be limited to the particular embodiment disclosed, but that the invention will include all embodiments falling within the scope of the appended claims.

The invention claimed is:

1. A flameless candle comprising:

a candle shell including a hollow interior region, an inner surface having a radius and an outer surface having a radius;

a riser located within the hollow interior region;

a lamp located within the hollow interior region and located above the riser; and a light shield located within the hollow interior region and located below the lamp, wherein the light shield includes:

an outer bound having a radius less than the radius of the inner surface of the candle shell thereby creating an air gap extending horizontally between the outer bound of the light shield and the inner surface of the candle shell, and a sloped portion including a slope;

wherein:

the sloped portion of the light shield slopes downwardly towards the outer bound;

the candle shell comprises an outer surface with an upper region at a height above the light shield and a lower region at a height below the light shield;

the lamp and the light shield are configured to shape an illumination pattern on the outer surface of the candle shell by unscattered light from the lamp passing through the air gap; and the illumination pattern comprises a tapered band having decreasing illumination intensity from a bottom area of the upper region through a top area of the lower region of the outer surface of the candle shell.

2. The flameless candle of claim 1, wherein a top surface of the light shield comprises a reflector.

3. The flameless candle of claim 1, wherein the light shield is configured to shape the tapered band at least according to:

the slope of the sloped portion of the light shield; and a width of the air gap.

4. The flameless candle of claim 1, wherein the illumination pattern comprises a focal band in the upper region of the outer surface of the candle shell.

5. The flameless candle of claim 4, wherein the light shield is configured to shape the focal band at least according to the slope of the sloped portion of the light shield.

6. The flameless candle of claim 1, further comprising a base portion configured to support the riser.

7. The flameless candle of claim 6, wherein the base portion includes an electronics portion configured to provide current to the lamp through a plurality of conductors.

8. The flameless candle of claim 7, wherein the electronics portion is further configured to cause the lamp to flicker.

9. The flameless candle of claim 1, further comprising a simulated wick located at a height above the lamp.

10. The flameless candle of claim 9, wherein the simulated wick is located directly above the lamp.

11. The flameless candle of claim 1, wherein the lamp comprises a light-emitting diode ("LED").

12. The flameless candle of claim 1, further comprising a light-diffusing member surrounding the lamp and configured to diffuse light emitted from the lamp.

13. The flameless candle of claim 1, further comprising an extension between the light shield and the lamp.

* * * * *